US007266313B2

(12) United States Patent
Yokoi et al.

(10) Patent No.: US 7,266,313 B2
(45) Date of Patent: Sep. 4, 2007

(54) IMAGE FORMING DEVICE AND SYSTEM THAT USE CONSUMABLE ITEMS AND METHOD OF CHANGING CONSUMABLE ITEMS

(75) Inventors: Katsuyuki Yokoi, Iwakura (JP); Tomoaki Hattori, Nagoya (JP); Masashi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/457,465

(22) Filed: Jun. 10, 2003

(65) Prior Publication Data

US 2003/0228163 A1 Dec. 11, 2003

(30) Foreign Application Priority Data

Jun. 10, 2002 (JP) ..... 2002-169177

(51) Int. Cl.
*G03G 15/00* (2006.01)

(52) U.S. Cl. ..... 399/24; 399/27

(58) Field of Classification Search ..... 399/8, 399/9, 12, 13, 24, 25, 27, 29, 26; 347/86; 702/184; 705/61

See application file for complete search history.

(56) References Cited

U.S. PATENT DOCUMENTS 6,295,423 B1 * 9/2001 Haines et al. ..... 399/24
6,301,449 B1 * 10/2001 Miura ..... 399/12
6,363,226 B1 3/2002 Batori
6,456,802 B1 * 9/2002 Phillips ..... 399/27
6,530,519 B1 * 3/2003 Suzuki ..... 235/375
6,594,451 B2 * 7/2003 Kakeshita et al. ..... 399/24
6,597,875 B2 7/2003 Hasegawa
6,621,989 B2 9/2003 Otomo et al.
6,636,702 B2 * 10/2003 Abe ..... 399/12
6,647,214 B2 * 11/2003 Takahashi ..... 399/13
6,701,096 B2 * 3/2004 Arai et al. ..... 399/12
6,704,521 B2 * 3/2004 Isobe et al. ..... 399/12
6,721,514 B2 * 4/2004 Kida ..... 399/12
6,748,182 B2 * 6/2004 Yoshida et al. ..... 399/12
6,754,454 B1 * 6/2004 Hiroshima et al. ..... 399/25
6,768,877 B2 * 7/2004 Alegria et al. ..... 399/9
6,798,997 B1 * 9/2004 Hayward et al. ..... 399/12

(Continued)

FOREIGN PATENT DOCUMENTS

JP 2000-125477 4/2000

(Continued)

*Primary Examiner*—Hoan Tran
(74) *Attorney, Agent, or Firm*—Oliff & Berridge, PLC

(57) ABSTRACT

A system of printers uses replicable toner boxes, which each has a unique serial number. Each printer determines once the toner box is empty. At this time, the printer registers the serial number of the used toner box in used toner box list in a memory. Each time a toner box is mounted in the printer, the printer reads and compares the serial number of the freshly inserted toner box with the serial numbers in the list in the memory. If the serial number of the presently mounted toner box matches any in the list, this means that the toner box has previously been judged to reach life end, so the printer displays a message that the toner box is not suitable for use in the printer and prevents further printing operations until the toner box is replaced with a new one.

39 Claims, 8 Drawing Sheets

U.S. PATENT DOCUMENTS 6,820,039 B2 * 11/2004 Johnson et al. ..... 702/184
6,978,255 B1 * 12/2005 Pauschinger et al. ..... 705/61

FOREIGN PATENT DOCUMENTS

JP 2001-075435 3/2001
JP 2001-100599 4/2001
JP 2001-1252376 5/2001
JP 2001-215779 8/2001
JP 2001-215785 8/2001
JP 2002-116680 4/2002

* cited by examiner

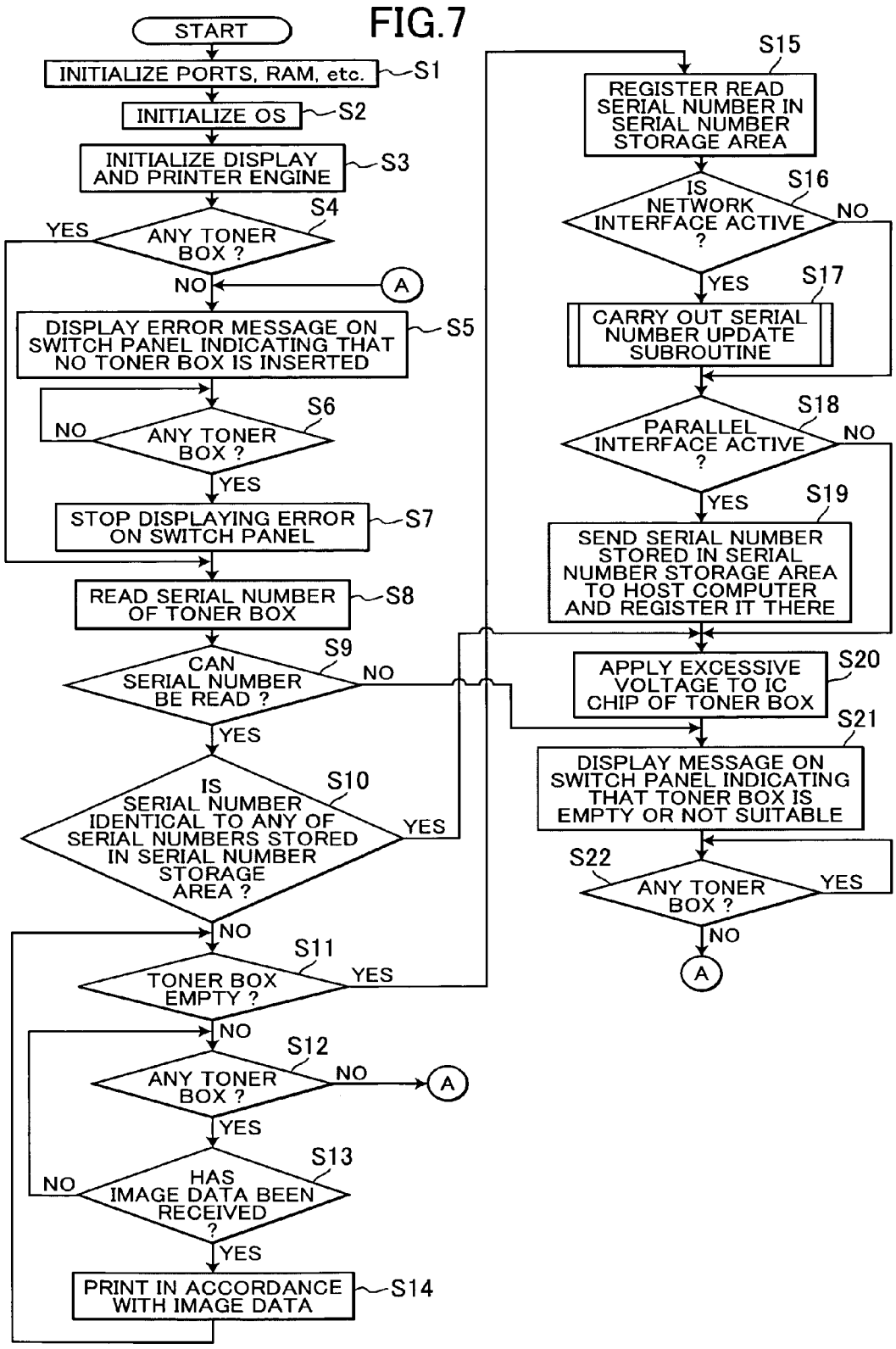
FIG.7
START
INITIALIZE PORTS, RAM, etc.
S1
INITIALIZE OS
S2
INITIALIZE DISPLAY AND PRINTER ENGINE
S3
ANY TONER BOX ?
S4
YES
NO
A
DISPLAY ERROR MESSAGE ON SWITCH PANEL INDICATING THAT NO TONER BOX IS INSERTED
S5
ANY TONER BOX ?
S6
NO
YES
STOP DISPLAYING ERROR ON SWITCH PANEL
S7
READ SERIAL NUMBER OF TONER BOX
S8
CAN SERIAL NUMBER BE READ ?
S9
NO
YES
IS SERIAL NUMBER IDENTICAL TO ANY OF SERIAL NUMBERS STORED IN SERIAL NUMBER STORAGE AREA ?
S10
YES
NO
TONER BOX EMPTY ?
S11
YES
NO
ANY TONER BOX ?
S12
NO
A
YES
HAS IMAGE DATA BEEN RECEIVED ?
S13
NO
YES
PRINT IN ACCORDANCE WITH IMAGE DATA
S14
REGISTER READ SERIAL NUMBER IN SERIAL NUMBER STORAGE AREA
S15
IS NETWORK INTERFACE ACTIVE ?
S16
NO
YES
CARRY OUT SERIAL NUMBER UPDATE SUBROUTINE
S17
PARALLEL INTERFACE ACTIVE ?
S18
NO
YES
SEND SERIAL NUMBER STORED IN SERIAL NUMBER STORAGE AREA TO HOST COMPUTER AND REGISTER IT THERE
S19
APPLY EXCESSIVE VOLTAGE TO IC CHIP OF TONER BOX
S20
DISPLAY MESSAGE ON SWITCH PANEL INDICATING THAT TONER BOX IS EMPTY OR NOT SUITABLE
S21
ANY TONER BOX ?
S22
YES
NO
A

IMAGE FORMING DEVICE AND SYSTEM THAT USE CONSUMABLE ITEMS AND METHOD OF CHANGING CONSUMABLE ITEMS

BACKGROUND OF THE INVENTION

1. Field of the Invention

The present invention relates to image forming apparatus, such as a laser printer, that uses consumable items.

2. Description of Related Art

Image forming apparatus such as laser printers contain several consumable items that must be replaced during the life of the apparatus. For example, developing cartridges containing toner can be inserted into and removed from the image forming apparatus, and normally when the toner is used up the developing cartridge is replaced with a new developing cartridge.

SUMMARY OF THE INVENTION

However, an image forming apparatus is precisely designed in order to obtain a good image. The toner, the developing cartridges containing the toner, and other consumable items are precisely designed to be suitable for each image forming apparatus in order to achieve the greatest performance.

However, when changing consumable items it is difficult for a user to judge whether the consumable item is suitable for the image forming apparatus or not. For example, if, after the toner has been consumed, the developing cartridge is again filled with toner and used, it is difficult to judge whether that toner is suitable for the image forming apparatus or not. If the toner is not suitable for the image forming apparatus then, for example, if the developing cartridge is inserted into the image forming apparatus and used it can result in lowered image quality or could damage the apparatus if used over a long period of time, resulting in the image forming apparatus having to be discarded.

From a consideration of these problems, it is an objective of the present invention is to provide an image forming apparatus, system, and method for changing the consumable items of the image forming apparatus that prevents damage to the image forming apparatus when improper consumable items are inserted in the image forming apparatus.

In order to achieve the above-described objective, an image forming apparatus according to the present invention includes a distinction information reading unit, a life end determining unit, a memory, a registering unit, and a suitability determining unit. The image forming apparatus uses a plurality of consumable items one at a time. Each of the consumable items is provided to the image forming apparatus during use and has a usable life that ends when the consumable item reaches life end. Each of the consumable items is provided with a distinction information indicator that indicates information for distinguishing between individuals in the plurality of consumable items.

The distinction information reading unit reads the distinction information indicated by the distinction information indicator of each consumable item that is presently provided in the image forming apparatus.

The life end determining unit judges whether a consumable item that is presently being used has reached life end.

The registering unit registers, in the memory and for each consumable item that the life end determining unit judges to have reached life end, the distinction information read by the distinction information reading unit.

The suitability determining unit determines that a consumable item that is presently provided is unsuitable for use in the image forming apparatus when distinction information read by the distinction information reading unit for the consumable item that is presently provided is the same as distinction information registered in the memory.

An image forming apparatus according to another aspect of the present invention includes an image formation unit and an eliminating unit. The image forming apparatus according to this aspect of the present invention uses a plurality of consumable items one at a time. Each of the consumable items is provided to the image forming apparatus during use and is provided with a semi-conductor element that stores distinction information for distinguishing between individuals of the plurality of consumable items.

The image formation unit performs image formation operations for forming images on a recording medium. The eliminating unit selectively eliminates distinction information from a semi-conductor element of a consumable item that is presently provided by applying an excessive voltage to the semi-conductor element of the consumable item that is presently provided.

According a method for changing consumable items in an image forming apparatus, a distinction information indicator is provided to each consumable item. Each distinction information indicator indicates distinction information for distinguishing each of the plurality of consumable items from others of the plurality of consumable items. Life end of a consumable item that is presently being used in the image forming apparatus is judged. Distinction information indicated by a distinction information indicator of each consumable item judged to have reached life end is read. Distinction information indicated by a distinction information indicator of each consumable item judged to have reached life end is registered in a memory. Whether distinction information indicated by a distinction information indicator of a consumable item that is presently provided in the image forming apparatus is the same as distinction information registered in the memory is judged. The consumable item that is presently provided is judged to be unsuitable for use in the image forming apparatus when the distinction information indicated by the distinction information indicator of the consumable item that is presently provided is judged to be the same as distinction information registered in the memory.

A system according to the present invention includes image forming apparatuses connected to each other through a network. Each image forming apparatus uses a plurality of consumable items one at a time. Each of the consumable items is provided to the image forming apparatus during use and has a usable life that ends when the consumable item reaches life end. Each of the consumable items is provided with a distinction information indicator that indicates information for distinguishing between individuals of the plurality of consumable items. The system includes the plurality of image forming apparatuses and a memory. Each image forming apparatus includes a distinction information reading unit, a life end determining unit, a registering unit, and a suitability determining unit.

The distinction information reading unit reads the distinction information indicated by the distinction information indicator of a consumable item that is presently provided.

The life end determining unit judges whether a consumable item that is presently being used has reached life end.

The registering unit that registers, in the memory and for each consumable item that the life end determining unit judges to have reached life end, the distinction information read by the distinction information reading unit.

The suitability determining unit determines that a consumable item that is presently provided is unsuitable for use when distinction information read by the distinction information reading unit for the consumable item that is presently provided is the same as distinction information registered in the memory.

BRIEF DESCRIPTION OF THE DRAWINGS

In the drawings:

FIG. 7 is a flowchart representing processes of a toner box suitability determination routine;

DETAILED DESCRIPTION OF THE PREFERRED EMBODIMENTS

Figure 1:
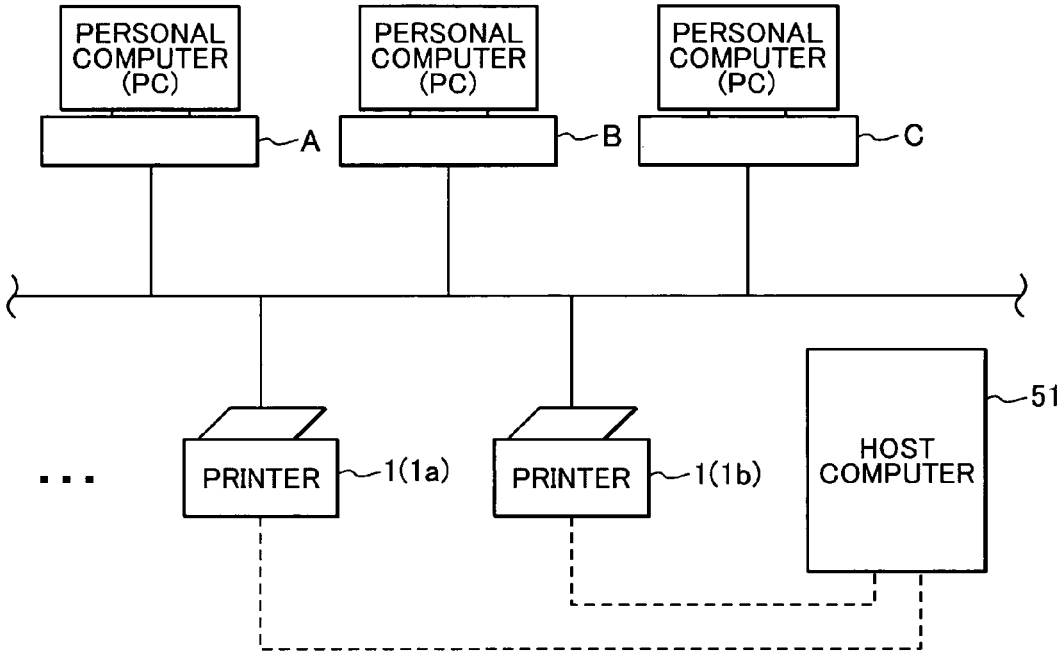
FIG. 1 is a block diagram of a system according to an embodiment of the present invention, the system including printers, personal computers, and a host computer.

FIG. 1 is a block diagram of a system according to an embodiment of the present invention. The system includes a personal computers A, B, and C, and a plurality of printers 1, all connected together by a network. The network could be a LAN within a company, the Internet, or some other network. Also, each printer 1 is connected to a host computer 51.

The printers 1 include printers 1*a* and 1*b* and are all printers produced by the same manufacturer. The printer 1*a* will be described next as a representative example of the printers 1. Note that all of the printers 1 have the same configuration, so the same toner box 33 to be described later can be used in all of the printers 1.

The printer 1*a* is a laser printer that includes a feeder unit 4 for supplying sheets 3 and a developing unit 5 for forming an image on the supplied sheet 3, all within a casing 2.

The feeder unit 4 is positioned towards the bottom of the casing 2 and includes a sheet supply tray 6 that can be inserted and removed, a sheet supply roller 7 located above one end of the sheet supply tray 6, a pair of register rollers 8 positioned downstream of the sheet supply tray relative to the direction of transport of the sheet 3, and a register sensor 31 positioned upstream of the register roller 8 relative to the direction of transport of the sheet 3.

The sheets 3 are supplied one sheet at a time by rotation, of the sheet supply roller 7 and transported towards the register rollers 8. The register rollers perform a specific register operation on each sheet 3 before transporting the sheet 3 to an image forming location where a photosensitive drum 13 and a transfer roller 15 contact each other.

The register sensor 31 includes an actuator that faces in the direction in which the sheet 3 is transported. The register sensor 31 is turned on when the actuator contacted by the sheet 3 and off when the actuator is not contacted by the sheet 3. The register sensor 31 detects the presence or absence of the sheet 3 by the on and off operation of the actuator.

The image forming unit 5 includes a scanner unit 9, a process unit 10, and a fixing unit 11. The scanner unit 9 is located within the casing 2 and towards the top and includes a reflection mirror 9*a* and although not shown on the drawings a laser emitting unit, a polygon mirror, and a several lenses. The laser emitting unit emits a laser beam based upon image data. The laser beam passes through or is reflected by the polygon mirror, lenses and reflection mirror 9*a*, and irradiates the surface of the photosensitive drum 13 in a high speed scan.

The process unit 10 is located below the scanner unit 9 and includes a developing cartridge 12, the photosensitive drum 13, a scorotron charge unit 14, the transfer roller 15, and a drum cleaning unit 16.

The developing cartridge 12 can be inserted and removed from the casing 2 and includes a developing roller 17, a toner box 33 for containing toner, and although not shown on the drawings a layer thickness regulating blade and a supply roller. Also, a developing bias is applied to the developing roller 17.

The toner box 33 can be inserted into and removed from the developing cartridge 12 and includes an IC chip 45 made from a semi-conducting element. The IC chip 45 is written with a serial number by a laser. The serial number serves as distinction information for distinguishing each toner box 33 from other toner boxes 33 based upon a predetermined rule. The CPU 35 can determined whether the toner box 33 is inserted in the casing 2 or not by detecting whether contact points on both the toner box 33 and the casing 2 are in contact or not.

The photosensitive drum 13 is located to the side of the developing roller 17 and in contact with the developing roller 17. The photosensitive drum 13 is driven by a motor not shown in the drawings to rotate in the clockwise direction of FIG. 2 as indicated by an arrow.

The scorotron charge unit 14 is positioned above the photosensitive drum 13, not in contact with and at a fixed distance from the photosensitive drum 13. The scorotron charge unit 14 is a positively-charging scorotron-type charge unit and includes a tungsten charge wire that generates a corona discharge. The scorotron charge unit 14 uniformly charges the surface of the photosensitive drum 13 with positive static charge.

The toner box 33 of the developing cartridge 12 contains non-magnetic single-component positively-charging approximately spherical-shaped polymer toner. The toner is supplied to the developing roller 17 by the rotation of the supply roller, and the layer of toner on the developing roller 17 is reduced to a uniform thin layer by the layer thickness regulating blade. The surface of the photosensitive drum 13 is uniformly positively charged by the scorotron charger 14. Next the surface of the photosensitive drum 13 is exposed to a high speed scan from a laser beam from the scanner unit 9 based upon image data, thereby forming an electrostatic latent image. In other words, the electro-potential of the positions on the uniformly positively-charged surface of the photosensitive drum 13 where the laser beam is exposed drops, thereby forming the electrostatic latent image. When, through the rotation of the developing roller 17, the toner on the developing roller 17 comes into contact with the photosensitive drum 13, the toner is selectively transferred to those parts of the surface of the photosensitive drum that have been exposed to the laser, thereby forming a developed (visible) image.

The transfer roller 15 is disposed below and in confrontation with the photosensitive drum 13, and supported so that it can rotate. The transfer roller 15 rotates in association with rotation of the photosensitive drum 13. During transfer of the visible image to the sheet 3, a specific transfer bias is applied to the transfer roller 17 with respect to the photosensitive drum 13. Therefore, when the sheet 3 passes between the photosensitive drum 13 and the transfer roller 17 the visible image on the photosensitive drum 13 is transferred to the sheet 3.

The drum cleaning unit 16 includes a drum cleaning roller 18, a secondary cleaning roller 19, a cleaning blade 20, and a waste toner tank 21. The drum cleaning unit 16 is disposed downstream of the transfer roller 17 and upstream of the scorotron charge unit 14, relative to the direction of rotation of the photosensitive drum 13.

The drum cleaning roller 18 is disposed in confrontation with and in contact with the photosensitive drum 13. The surface of the drum cleaning roller 18 is made from an electrically conducting elastic body. A bias is applied to the drum cleaning roller 18 with respect to the photosensitive drum 13.

The secondary cleaning roller 19 is disposed downstream of the photosensitive drum 13 with respect to the direction of rotation of the drum cleaning roller 18, and on the opposite side of the drum cleaning roller 18 from the photosensitive drum 13. The secondary cleaning roller 19 is in contact with and in confrontation with the drum cleaning roller 18. The secondary cleaning roller 19 is made of metal, and a bias is applied relative to the drum cleaning roller 18.

The cleaning blade 20 is disposed downstream of the drum cleaning roller 18 with respect to the direction of rotation of the secondary cleaning roller 19, and on the opposite side of the secondary cleaning roller 19 to the drum cleaning roller 18. The cleaning blade 20 is in contact with and in confrontation with the secondary cleaning roller 19. The cleaning blade 20 is a thin plate scraping blade and it scrapes toner from the surface of the secondary roller 19.

Any toner remaining on the photosensitive drum 13 after transferring the image to the sheet 3, is brought into confrontation with the drum cleaning roller 18 by the rotation of the photosensitive drum 13. The toner is electrically captured by the drum cleaning roller 18. By the rotation of the drum cleaning roller 18, the captured toner is brought into confrontation with the secondary drum cleaning roller 19. The toner is electrically captured by the secondary drum cleaning roller, and is then scraped off and collected in the waste toner tank 21.

The fixing unit 11 is disposed to the side of and downstream of the process unit 10. The fixing unit 11 includes a heating roller 22, a pressure roller 23 that presses against the heating roller 22, a sheet discharge sensor 24 and a pair of transport rollers 25 disposed downstream of the heating roller 22 and the pressure roller 23.

The heating roller 22 is made from metal and has a heater 26 to heat the heating roller 22. Also, the pressure roller 23 is disposed in confrontation with the heating roller 22 in order to press against the heating roller 22. The toner transferred onto the sheet 3 in the process unit 10 is fixed to the sheet 3 when the sheet 3 passes between the heating roller 22 and the pressure roller 23. Then the sheet 3 is transported to the sheet discharge rollers 27 by the transport rollers 25, and the discharge rollers discharge the sheet 3 into the sheet discharge tray 28. The sheet discharge sensor 24 is disposed downstream of the transport rollers 25, and installed on a rear opening/closing cover 32*b* described later.

Figure 2:
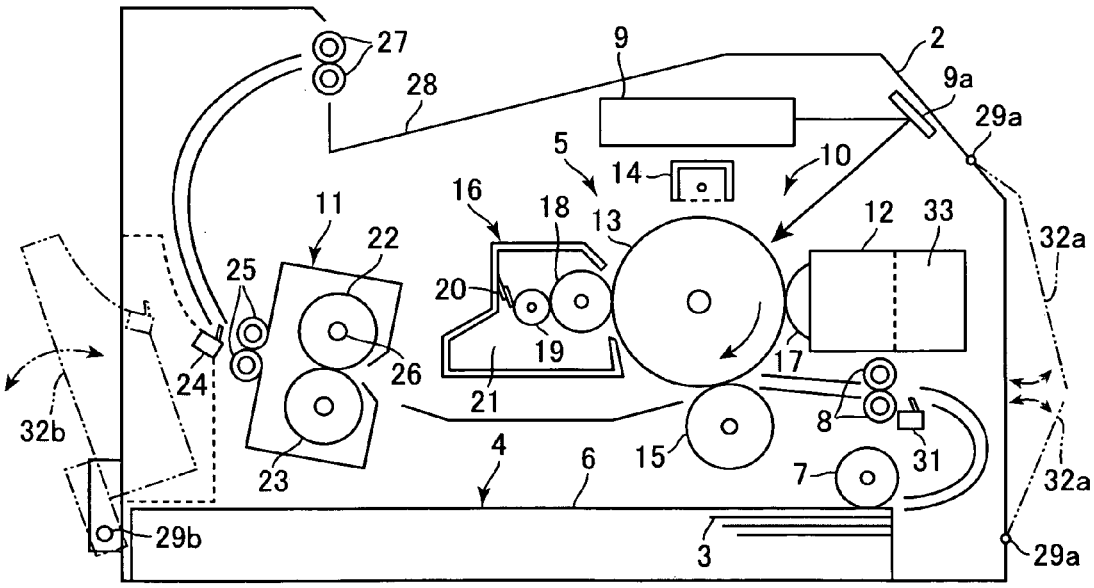
FIG. 2 is a sectional view showing the main elements of one of the printers in FIG. 1.

Also, a front opening/closing cover 32*a* is provided at the front of the main casing 2 as indicated by a two-dot chain line in FIG. 2. The front opening/closing cover 32*a* is supported by hinges 29*a* in the top and bottom of the front of the main casing 2. The toner box 33 or the developing cartridge 12 of the process unit 10 is exchanged by opening the front opening/closing cover 32*a* and removing the toner box 33 or the developing cartridge 12 from the printer 1*a* and inserting another the toner box 33 or the developing cartridge 12 in the printer 1*a*.

Also, the rear opening/closing cover 32*b* is provided at the rear of the main casing 2 as indicated by a two-dot chain line and broken line in FIG. 2. The rear opening/closing cover 32*b* is supported by a hinge 29*b* in the bottom of the rear of the main casing 2. To change the fixing unit 11, the rear opening/closing cover 32*b* is opened and the fixing unit 11 is removed from the printer 1*a* and a new fixing unit 11 is inserted into the printer 1*a*.

The printer 1*a* includes a CPU 35 that determines whether the toner box 33 is suitable or not for use in the printer 1*a*. In addition, the CPU 35 carries out a serial number update subroutine that enables the printer 1*a* to share information about the serial numbers of used toner boxes 33 (hereafter called used serial numbers) with all of the printers 1 on the network, so that the use of unsuitable toner boxes 33 is prevented. Processes for achieving this configuration will be described later.

Figure 3:
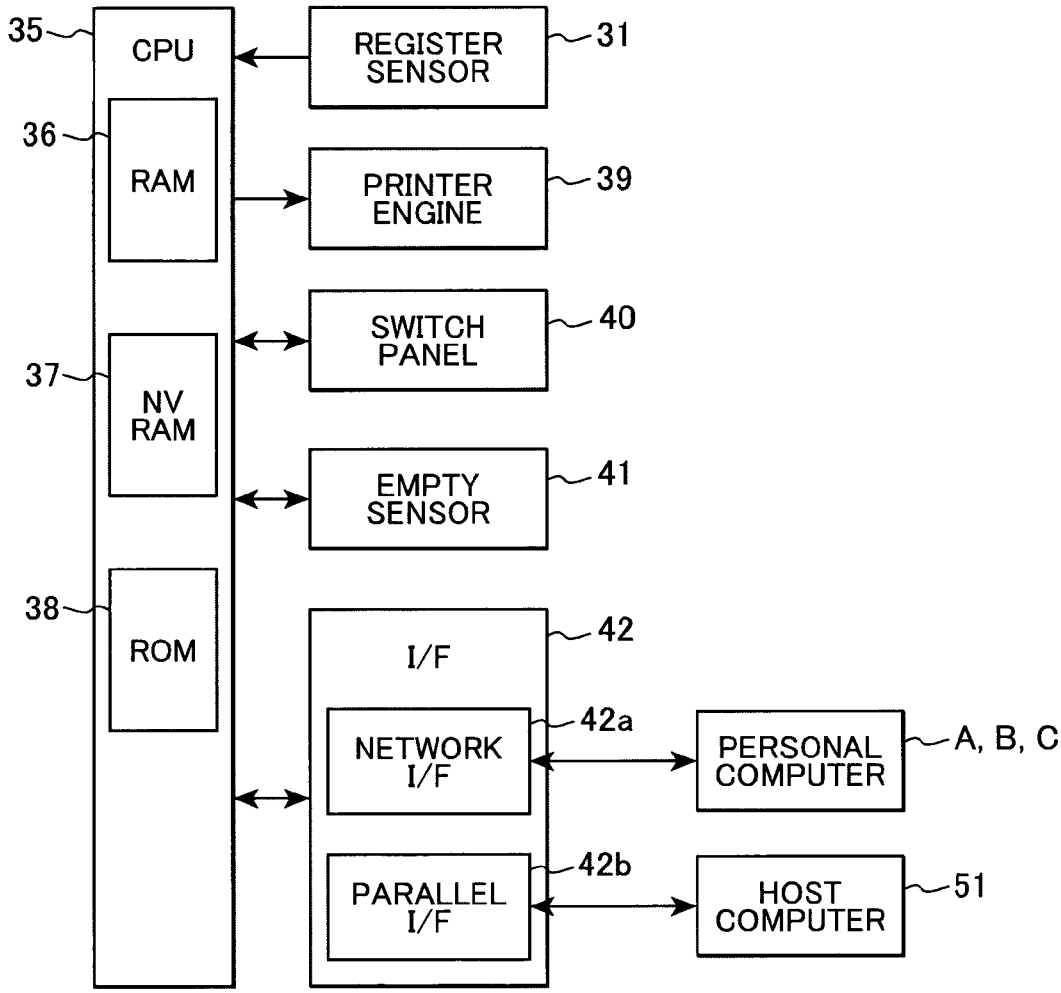
FIG. 3 is a block diagram of the printer in FIG. 2.

FIG. 3 is a block diagram showing electrical components of the printer 1*a*. As shown in FIG. 3, the register sensor 31, a printer engine 39, a switch panel 40 which displays various types of settings for the printer 1*a*, an empty sensor 41 that is within the toner box 33 and detects when the toner is used up, and an interface 42 are connected to the CPU 35.

The CPU 35 includes a RAM 36, a NVRAM 37, and a ROM 38, and controls various components of the printer 1*a*.

Figure 4A:
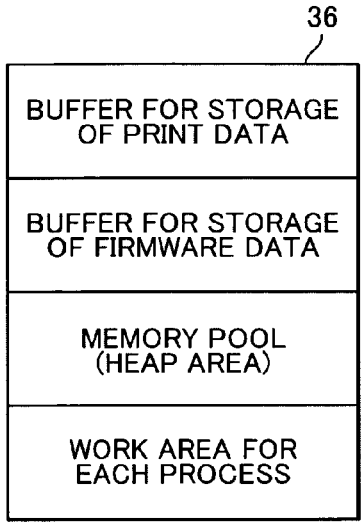
FIG. 4A is a schematic view showing the storage areas in a RAM in the printer of FIG. 2.

The RAM 36 stores temporary data from the register sensor 31, the switch panel 40, the empty sensor 41, the interface 42, and other components of the printer 1*a* in order to control the operation of each component. FIG. 4A shows various storage regions in the RAM 36. As shown in FIG. 4A, the RAM 36 is divided into a printer data storage buffer that stores data received from personal computer A through personal computer C, a firmware storage buffer, a memory pool (heap area) that dynamically allocates memory for each process as required, and a fixed allocated work area for each process. All the flags, pointers to lists, and the like used in each process are included in the work area for each process. Also, regions of the memory pool are allocated one after the other as needed for a task stack area and for each entry of a same-manufacturer-search results list.

Figure 5:
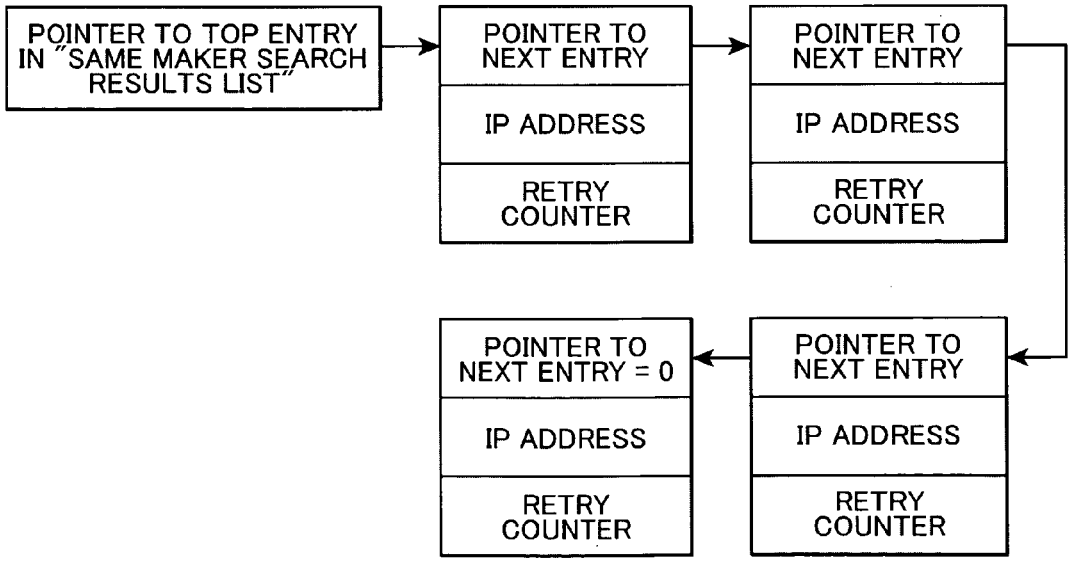
FIG. 5 is a diagram showing configuration of a same-manufacturer-search results list stored in a memory pool of the RAM of FIG. 4A.
Figure 8:
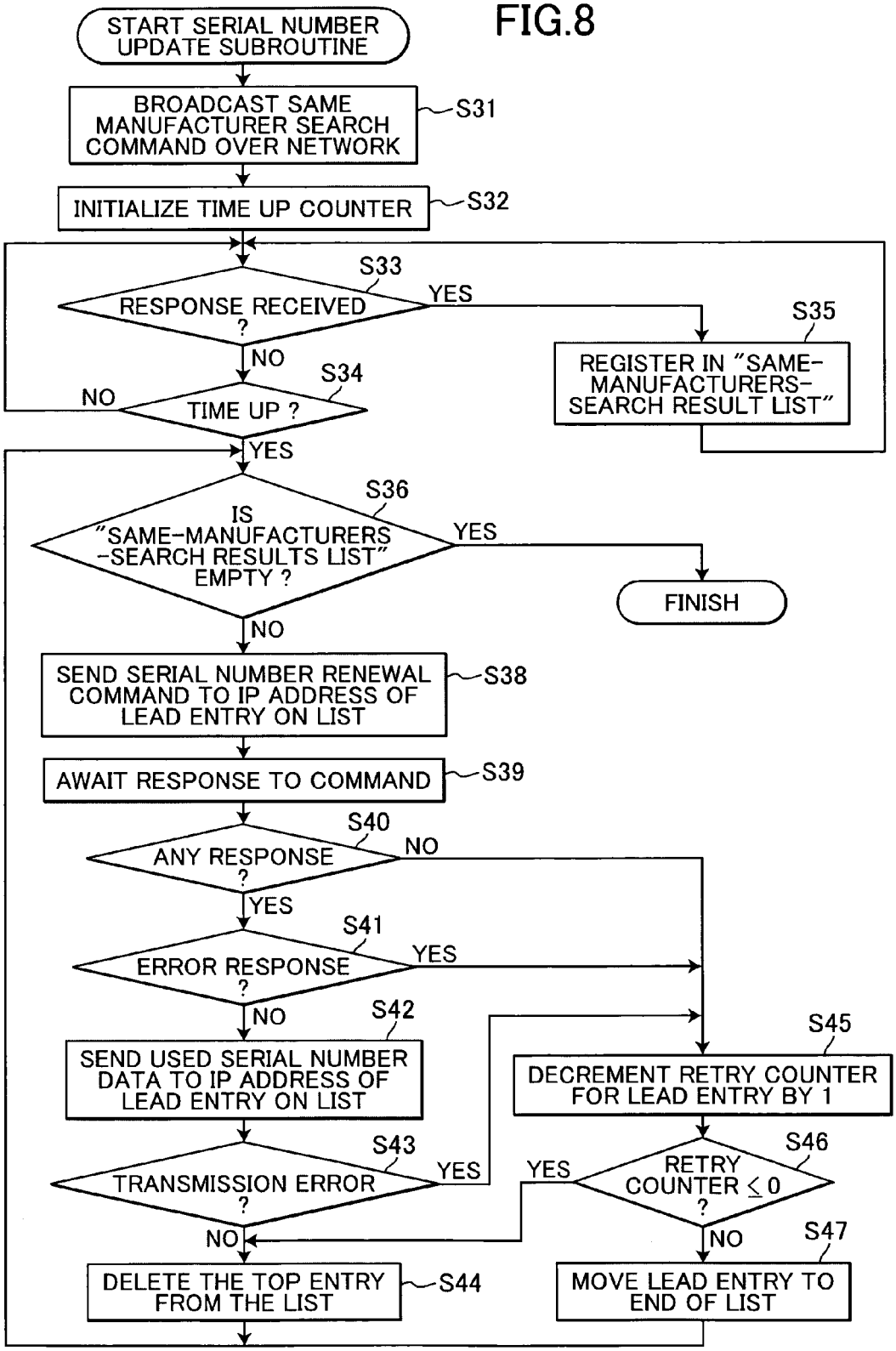
FIG. 8 is a flowchart showing processes of a serial number update subroutine.

The same-manufacturer-search results list is created by a serial number update subroutine represented by the flowchart in FIG. 8. As shown in FIG. 5, the same-manufacturer-search results list includes a group of entries and a pointer to the first entry in the list. The entries are arranged in a linear list. The pointer to the first entry is initialized to 0 by the start up process of the serial number update subroutine, indicating that there is no entry in the same-manufacturer-search results list. Each entry on the list is created by the same manufacturer search task (the process indicated by steps 31 to 33 in FIG. 8) of the serial number update subroutine when there is a response from another printer that is made by the same manufacturer as the printer 1*a*. Hereinafter, the printer 1*b* will be used as an example of one of the printers 1 that is made by the same manufacturer as the printer 1*a*. When a response from the printer 1*b* is received, an area is allocated in the memory pool and the entry is added to the end of the list. Each entry includes a pointer to the next entry (the pointer in the final entry is 0), the IP address of that printer 1*b* of the same manufacturer, and a retry counter.

Figure 4B:
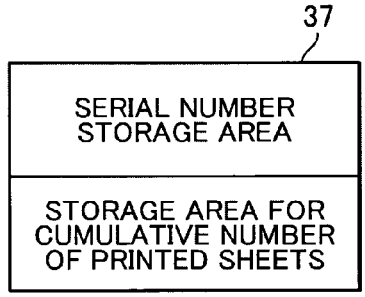
FIG. 4B is a schematic view showing storage areas of an NVRAM in the printer of FIG. 2.

As shown in FIG. 4B, the NVRAM 37 is divided into a serial number storage area, where the serial numbers of toner boxes 33 are stored, and a cumulative number of sheets printed storage area.

The CPU 35 is provided with a page counter that is incremented by one each time the register sensor is turned on and off by a sheet passing by. In this way, the page counter counts the cumulative number of sheets printed. The page counter starts counting the cumulative number of sheets printed each time a toner box 33 is used for the first time. The resultant cumulative number of sheets is stored in the cumulative number of sheets printed storage area that corresponds to the serial number of the specific toner box 33. As stated later, when a new toner box 33 is mounted in the printer 1*a*, an initialization process initializes (erases) the cumulative number of sheets printed is initialized. The data stored in the NVRAM 37 is maintained by a back-up power source, even when the power source of the laser printer 1 is turned off.

The ROM 38 stores a program with various control processes, such as a toner-box-serial-number reading process (S9 of FIG. 7), a used-serial-number reading process (S50 to S58 of FIG. 9), a life determination process (S11 of FIG. 7), a registration process (S15), a suitability determination process (S9 and S10 of FIG. 7), an initialization process, and others. The toner-box-serial-number reading process is for reading the serial number of the toner box 33 presently provided in the printer 1*a*. While the printer 1*a* performs a serial number update subroutine of FIG. 8, the other printer 1*b* performs the used-serial-number reading process to read the used serial numbers sent by printer 1*a* and store the used serial numbers in the serial number storage area of the NVRAM 37 of the printer 1*b*. The life determination process is for determining when the toner box 33 presently provided in the printer 1*a* has reached life end. A toner box 33 that has reached the end of its usable life will be alternately referred to as a used toner box hereinafter. The registration process is for registering the serial number of used toner boxes 33 into the serial number storage area. The suitability determination process determines that the toner box 33 mounted in the printer 1*a* is unsuitable for the printer 1 when the toner box serial number read by the toner-box-serial-number reading process is the same as one of the serial numbers stored in the serial number storage area.

The printer engine 39 includes mechanisms for forming images in the printer 1*a*.

Although not shown in FIG. 2, the switch panel 40 is provided on the top of the main casing 2 and includes a liquid crystal display and operation keys. The liquid crystal display is for displaying various information regarding the printer 1*a* to the user. The operation keys are for operating the printer 1*a*. When there is no toner or the toner is unsuitable, a message indicating this is displayed on the switch panel 40 as controlled by the CPU 35.

The empty sensor 41 is an optical sensor including a light emitter and a light receiver. The light emitter and the light receiver are mounted to the outside of two windows not shown in the drawings. The two windows are located on confronting side walls of the toner box 33 in alignment with each other. The light emitter and light receiver face each other through the windows. The empty sensor 41 detects whether any toner remains using the quantity of light emitted from the light emitter and the quantity of light received by the light receiver, and inputs a detection signal to the CPU 35 accordingly.

The interface 42 includes a network interface 42*a* and a parallel interface 42*b*. The network interface 42*a* is connected to personal computers A through C and the other printers 1, through the network. The personal computers A through C and the printers 1 can sent information to and receive information from each other through the network. The parallel interface 42*b* is connected to the host computer 51 and enables the printers 1 and the host computer 51 to send information to and receive from each other.

Figure 6:
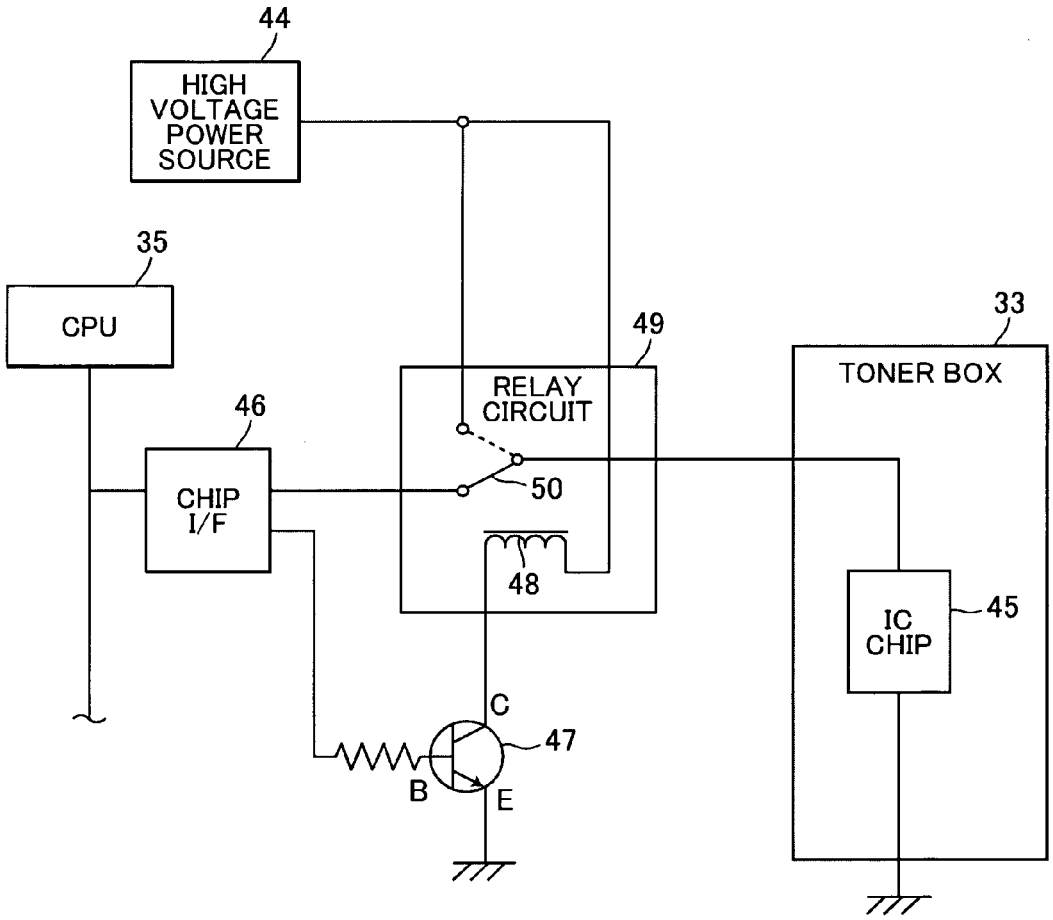
FIG. 6 is a circuit diagram showing configuration for reading and erasing (destroying) an IC chip connected to each toner box used in the printer of FIG. 2.

Also, as shown in FIG. 6, the CPU 35 has a chip interface 46, and is connected to the IC chip 45 of the toner box 33 through a relay circuit 49. As shown in FIG. 6, the relay circuit 49 includes a switch 50 and a coil 48. The switch 50 is in the position indicated in solid line when turned on and in the position indicated in dotted line when turned off. The IC chip 45 is connected to the chip interface 46 when the switch 50 is turned on and to a high voltage power source 44 when the switch 50 is turned off. Also, the upstream side of the coil 48 is connected to the high voltage power source 44 and the downstream side of the coil 48 is connected to the collector side of a transistor 47.

Under the control of the CPU 35, base current is normally flowing from the chip interface 46 to the transistor 47. Because of this the collector-emitter of the transistor 47 is turned on, and the coil 48 is excited by the voltage applied by the high voltage power source 44. Therefore, the switch 50 is normally turned on so that the IC chip 45 is connected to the CPU 35, through the relay circuit 49 and the chip interface 46. In this way the serial numbers of the IC chip 45 can be read by the toner-box-serial-number reading process on the CPU 35.

When the CPU 35 executes a toner box suitability determination program to be described later and determines that the toner box 33 presently provided the printer 1*a* is unsuitable or that no toner remains, the CPU 35 controls the chip interface 46 to stop flow of the base current to the transistor 47. In this case, excitation of the coil 48 stops so that the switch 50 of the relay circuit 49 turns off, which brings the IC chip 45 and the high voltage power source 44 into electrical connection with each other. As a result, the high voltage power source 44 applies an excessive voltage to the IC chip 45 so that the IC chip 45 is burned out and the serial number can no longer be read.

Next, the procedure for determining the suitability of the toner box 33 presently provided in the printer 1*a* and the serial number update subroutine will be explained with reference to FIG. 7 and FIG. 8.

In FIG. 7, first the printer 1*a* is started by turning the power on. At this time, a boot process is started by a resetting operation of the CPU 35 within the printer 1*a*. In other words, the RAM 36, necessary input and output ports for the CPU 35, and the like are initialized (S1), the operation system is initialized (S2), the LEDs and other displays and the printer engine 39 is initialized (S3), and a check for the presence of toner boxes 33 is carried out (S4).

If a toner box 33 is present (S4: YES), then the serial number of the toner box 33 is read by the toner-box-serial-number reading process (S8).

On the other hand, if a toner box is not present (S4: NO), then an error message stating that there is no toner box 33 is displayed on the liquid crystal display of the switch panel 40 (S5), and the device awaits the insertion of a toner box 33 (S6: NO). When a user inserts a toner box (S6: YES), then the error message displayed on the switch panel 40 is turned off, and the serial number of the toner box 33 is read by the toner-box-serial-number reading process (S8).

If the serial number is read by the toner-box-serial-number reading process at S8 (S9: YES), then the suitability determination process checks whether the serial number read is identical to any of the used serial numbers stored in the serial number storage area of the NVRAM 37 (S10). If the serial number read is not identical with any of the used serial numbers (S10: NO), then the life determination program determines whether any toner remains or not in the toner box 33 (S11). If some toner remains (S11: NO), then the presence of the toner box 33 is again checked to determine whether the user has removed the toner box 33 or not. If the toner box is present (S12: YES), then the image data is received (S13: YES) and printing is carried out in accordance with the image data until toner runs out (S14). When image data cannot be read (S13: NO), then the procedure returns to S12 and waits to receive data while checking for the presence of a toner box 33. If during this waiting condition (S13: NO, S12: YES) the toner box is removed (S12: NO), then the processes from S5 on are repeated.

On the other hand, if at S9 the toner-box-serial-number reading process is not able to read the serial number (S9: NO), then the suitability determination process determines that the toner box is not suitable, and move to S21, whereupon a message that the toner box 33 is empty or is unsuitable will be displayed on the liquid crystal display of the switch panel 40 (S21) and the program waits for the toner box 33 to be removed (S22: YES).

If the serial number read by the toner-box-serial-number reading process in S10 is identical to a used serial number stored in the serial number storage area (S10: YES), then the suitability determination process determines that the toner box is unsuitable for use in the printer 1*a*. The procedure then moves to S20, whereupon the chip interface 46 operates to connect the IC chip 45 to the high voltage power source 44. As a result, the high voltage power source 44 applies an excessive voltage to the IC chip 45 to erase the serial number so the serial number cannot be read (S20). A message that the toner box 33 is empty or is unsuitable is then displayed on the liquid crystal display of the switch panel 40 (S21) and the program waits for the toner box 33 to be removed (S22: YES).

If in S11 the empty sensor 41 detects that the toner is empty (S11: YES), then the life determination program determines that the toner box 33 has reached its life end. As a result, the serial number of the toner box 33 read by the toner-box-serial-number reading process is registered in the serial number storage area by the registration process (S15). If the network interface 42*a* is active at this time (S16: YES), a serial number update subroutine is carried out (S17). On the other hand, if the network interface 42*a* is not active (S16: NO) then the serial number update subroutine is skipped.

FIG. 8 shows the serial number update subroutine. As shown in FIG. 8, when the serial number update subroutine is started, first a same manufacturer search command is broadcast across the network (S31). Next, a time up counter is initialized and started (S32) and responses to the same manufacturer search command are awaited from the other printers 1 on the network (S32). The time up counter is for judging whether a predetermined time for waiting for responses has elapsed, and is decremented using an interval timer interrupt process. Each time a response to the same manufacturer search command is received from another of the printers 1 (S33: YES), then a new entry is added to the same-manufacturer-search results list of FIG. 5. Each new entry includes the IP address of the corresponding one of the printers 1 (printer 1*b* in this example) and a fixed number of retries for that printer 1*b*. In this way, those of the printers 1 that are produced by the same manufacturer are successively registered in the same-manufacturer-search results list (S35). For example, if the printer 1*a* receives a response from printer 1*b*, printer 1*a* creates a list entry with the IP address of printer l*b* and a fixed number of retries, and adds the entry to the end of the same-manufacturer-search results list. In this way, the same manufacturer printer 1*b* is registered in the list of the printer 1*a*.

If no response is received (S33: NO), the time up counter is checked to determine whether the predetermined time for waiting for responses has elapsed (S34). If not (S34: NO), then whether any responses have arrived is again checked. Once the predetermined time has elapsed (S34: YES) then whether the same-manufacturer-search results list is empty or not is judged (S36). If the list has no entries (S36: YES), then the serial number update subroutine is terminated.

On the other hand, if the same-manufacturer-search results list has some entries, or more precisely, at least one entry (S36: NO), then an update command is sent to the IP address of the lead entry of the list (S38) and a response to the command is awaited (S39). If a response to the command is received (S40: YES), whether the response is an error response or not is checked (S41). If the response is not an error response (S41: NO), then the used serial number that was added to the serial number storage area of the NVRAM 37 in S15 is transmitted to the IP address in the lead entry of the list (S42).

Figure 9:
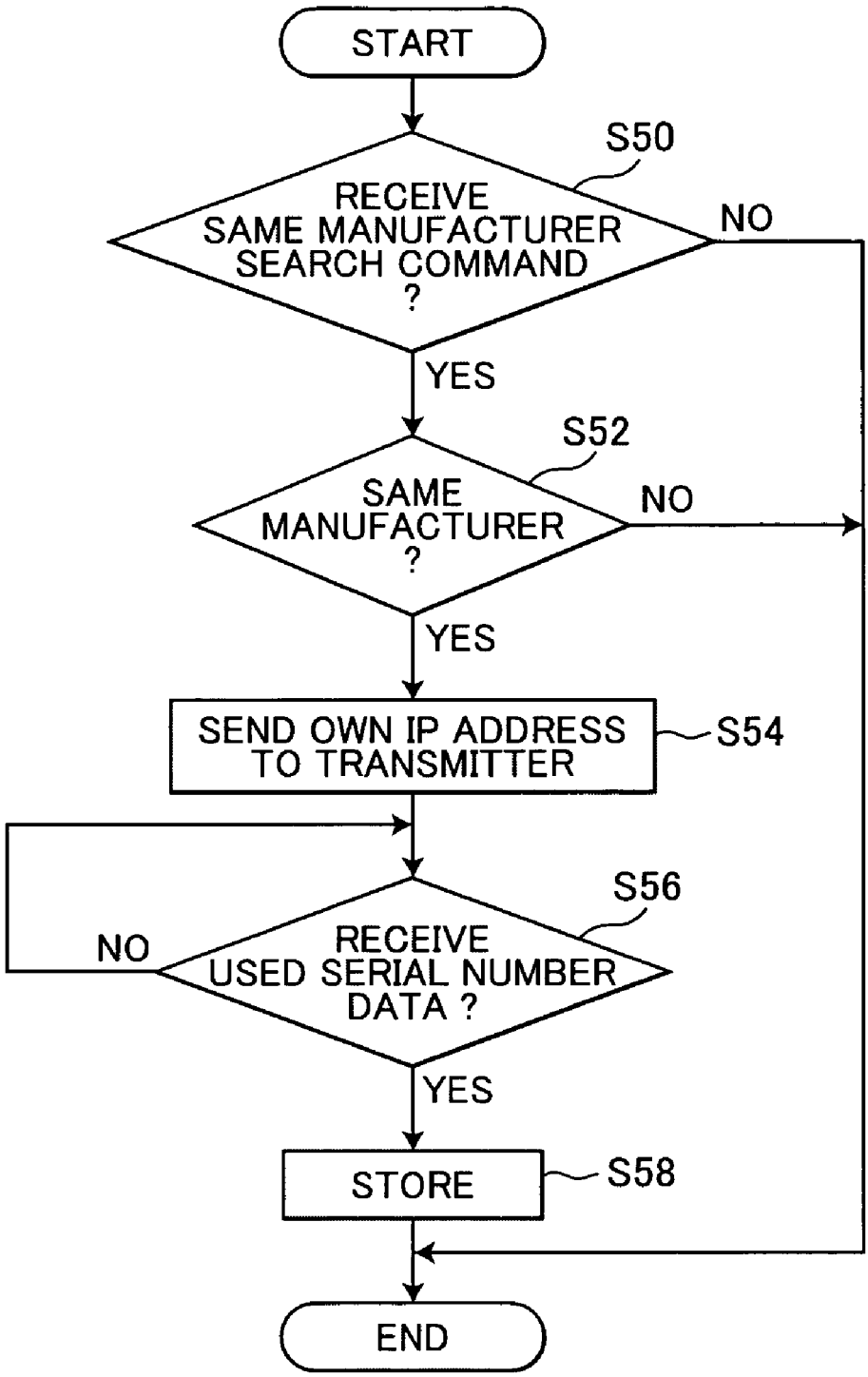
FIG. 9 is a flowchart representing processes performed by a printer that receives and stores used serial number information from another printer of the system of FIG. 1.

FIG. 9 is a flowchart representing the used-serial-number reading process performed in the printer 1*b*, which provided the response in S40. The used-serial-number reading process of the printer 1*b* is an interrupt routine periodically performed by the CPU of the printer 1*b*. When started, then it is judged whether the same manufacturer search command sent in S31 of FIG. 8 was received (S50). When the same manufacturer search command is received (S50: YES), then whether the printer that sent the same manufacturer search command, that is, to the printer 1*a* in this example, is made by the same manufacturer as the printer 1*b* is checked (S52). If so (S52: YES), then the printer 1*b* sends its IP address to the transmitter of the command, that is, to the printer 1*a* in this example. Once the printer 1*b* receives used serial number data that was transmitted in S42 (S56: YES), then the printer 1*b* reads the used serial number and registers the used serial number data by storing used serial number data in the serial number storage area of the NVRAM 37 (S58). On the other hand, the interrupt routine promptly ends if no same manufacturer search command is received (S50: NO) or then the printer that sent the same manufacturer search command is made by a different manufacturer (S52: NO).

Returning to the processes shown in FIG. 8, if there is no transmission error (S43: NO), then the lead entry is removed from the list (S44) and the procedure returns to S36, so that the update command and serial number are repeatedly transmitted until the same-manufacturer-search results list is empty (S36 to S44).

If there is no response at S40 (S40: NO), then the retry counter of the lead entry is decremented by 1 (S45) and a check is made whether the retry counter is 0 or less (S46).

If the retry counter is greater than 0 (S46: NO), then the lead entry is moved to the end of the list (S47). On the other hand, if the retry counter is 0 or less (S46: YES), the procedure moves to S44, whereupon the lead entry is removed from the list and the next entry in the list is processed from S36.

The program moves to S45 if a response received in S41 for the command is an error (S41: YES) or if a transmission error is judged in S43 to have occurred (S43: YES).

Once it is judged that the list is empty (S36: YES), the serial number update subroutine is terminated and the procedure returns to S18 of the toner box suitability determination program of FIG. 7. If the parallel interface 42*b* is active at this point in the toner box suitability determination program (S18: YES), then the registration process sends the serial number stored in the serial number storage area to the host computer 51 (S19), whereupon the host computer 51 registers the serial number in its memory. On the other hand, if the parallel interface 42*b* is not active (S18: NO), then the registration process of S19 is skipped.

After this, as described above, an excessive voltage is applied to the IC chip 45 of the toner box 33 so that the serial number in the IC chip 45 is erased and cannot be read (S20). Then a message that the toner box 33 is empty or unsuitable is displayed on the switch panel 40 (S21) and the device waits until the toner box 33 is removed (S22: YES). When the user removes the toner box 33 (S22: NO), the procedure returns to S5 and again waits for the insertion of a toner box 33 (S6). Once a toner box 33 is inserted (S6: YES), then S7 and on are performed.

From the time the toner box 33 is removed (S22: NO) until a toner box 33 is inserted (S6: YES), error processes will be performed that prevent printing operations from being carried out. For example, even if one of the personal computers A, B, C sends image data, the printer 1*a* performs controls to not receive the image data. That is, the personal computers A, B, C and the printers 1 use a well-known protocol relating to data transmission and reception. Under this protocol, the personal computers A, B, C transmit data packets to the printer 1*a*. When the printer 1*a* receives a data packet, from the personal computer A for example, then under normal circumstances the printer 1*a* transmits an ACK signal to personal computer A to confirm receipt of the data packet. However, when no toner box 33 is mounted in the printer 1*a* (S22: NO), then the printer 1*a* does not return an ACK signal even if the personal computer A transmits a data packet. The personal computer A will eventually stop attempting to resend the data packet once a timer runs out. Once a toner box 33 is mounted into the printer 1*a* (S6: YES), then the printer 1*a* will send an ACK signal to the personal computer A, which sends the next data packet as a result.

The life determination process of S11 of the toner box suitability determination program of FIG. 7 determines that the life of the toner box 33 has expired when it determines that the toner box 33 is empty. Then the registration process of S15 registers the serial number of the toner box 33 whose life has been judged to have expired in the serial number storage area of the NVRAM 37 as the serial number of a used toner box 33. Then, when the used toner box 33 is removed and a new toner box is inserted, the serial number of the newly-inserted toner box 33 is read by the toner-box-serial-number reading process of S8. Then the suitability determination process in S10 compares the serial number of the toner box 33 read by the toner-box-serial-number reading process with the used serial number or numbers stored in the serial number storage area by the registration process. If the serial number of the newly-inserted toner box 33 is the same as any of the registered used serial numbers, then the newly-inserted toner box 33 is determined to be unsuitable for use in the printer 1*a*. In other words, because the serial number of the used toner box 33 is registered in the serial number storage area of the NVRAM 37, then the serial number of the used toner box 33 will be identical with one of the registered used serial numbers when the used toner box 33 is again inserted into printer 1*a*. As a result, the used toner box 33 will be determined to be unsuitable for use in the printer 1*a*. In this way, even if an improper toner box 33 is mounted in the printer 1*a* by mistake, this will be immediately identified so that poor image formation and damage to the printer 1*a* can be prevented. As a result, by only allowing proper toner boxes to be used, good image quality will be achieved.

Because the NVRAM 37 includes a serial number storage area and used serial numbers are automatically registered in this serial number storage area, the device configuration is simplified.

Also, the printer 1*a* is connected to other printers 1 through the network interface 42*a*. Therefore, when any of the printers 1 determine that a toner box 33 has reached life end, that printer uses the serial number update subroutine to transmit the serial number of the used toner box 33 to the other printers 1 and the other printers 1 use the used-serial-number reading process to register the serial number of the used toner box 33 in the serial number storage area of the NVRAM 37. Because of this, the serial numbers of toner boxes 33 read by the toner-box-serial-number reading process of any of the printers 1 can be compared with the used serial numbers of toner boxes 33 read by the used-serial-number reading process. When the serial number of the mounted toner box 33 matches the serial number of one of the used toner boxes 33, then the presently mounted toner box 33 is determined to be unsuitable. In this way, not only the printer 1*a* in which the used toner box 33 is presently being used, but all the other printers 1 that are connected to the network can avoid poor image formation and damage caused by use of an unsuitable toner box 33.

Also, the toner box 33 is determined to be unsuitable if the serial number cannot be read by the suitability determination process in S9 of the toner box suitability determination program of FIG. 7. In other words, if a toner box 33 with no serial number, that is, with the serial number erased, is inserted in one of the printers 1, then the toner-box-serial-number reading process in S8 will not be able to read the serial number of the toner box 33, so the suitability determination process in S9 will determine that the toner box 33 is unsuitable. In this way, if an improper toner box is mounted, poor image formation and damage to the printer 1*a* can be prevented.

Also, as described above, the serial number is provided on the IC chip 45 made from a semi-conductor element provided to the toner box 33. When the suitability determination process in S10 determines that the toner box 33 is unsuitable, the serial number is erased by the application of an excessive voltage from the high voltage power source 44. Therefore, if the toner box 33 is ever again mounted in one of the printers 1, the toner-box-serial-number reading process in S9 would be unable to read the serial number, and the toner box 33 would be determined as unsuitable. As a result, even a used toner box 33 is used to replace another by mistake, the used toner box 33 would be reliably determined as unsuitable. Also, the IC chip 45 that includes the serial number is a semi-conductor element so that the serial number can be erased by the application of an excessive voltage from the high voltage power source. Hence, by this simple configuration the serial number can be reliably erased.

Also, when the suitability determination process determines that a toner box 33 is unsuitable, then a corresponding message is displayed on the switch panel 40 in S21 and 22 of FIG. 7. That is, the message indicates that the toner is empty or unsuitable, thereby prompting the user to change the toner box 33. While the message is displayed, print data cannot be received nor can images be printed. Hence, defective image formation and damage to the printer 1 that can occur when an improper the toner box 33 is mounted can be prevented.

Also, because the message about the empty or otherwise unsuitable toner box 33 is displayed, the user can be immediately notified about the unsuitable toner box 33, so that appropriate measures can be rapidly taken.

Because the printer 1 uses the control system described above, poor image formation and damage to the printer 1 can be prevented even if an improper toner box 33 is mounted in the printer 1. Therefore, used toner boxes 33 will be replaced with proper toner boxes 33, so that good image formation can be achieved.

While the invention has been described in detail with reference to a specific embodiment, it would be apparent to those skilled in the art that various changes and modifications may be made therein without departing from the spirit of the invention.

For example, in the embodiment the suitability determination process in S10 compares the serial number of the toner box 33 read by the toner-box-serial-number reading process in S8 with the used serial numbers registered in the serial number storage area of the NVRAM 37. However, the suitability determination process can be modified to compare the serial number of the toner box 33 read by the toner-box-serial-number reading process in S8 with used serial numbers registered in some other memory area, such as the serial number registered in the memory of the host computer 51 during S19 of the toner box suitability determination program of FIG. 7. In this case also, a toner box 33 with the same serial number as a registered one will be determined to be unsuitable.

Described in more detail, while the parallel interface 42*a* is active, the suitability determination process in S10 of the flowchart of FIG. 7 determines whether the serial number read by the toner-box-serial-number reading process in S8 is identical with any of the used serial numbers registered in the memory of the host computer 51. All the used serial numbers registered in all the printers 1 connected to the host computer 51 are registered in the memory of the host computer 51. If the serial number read by the toner-box-serial-number reading process in S8 is identical with any of the used serial numbers registered in the memory of the host computer 51, then the toner box 33 is determined to be unsuitable for use.

This configuration is particularly effective when many printers 1 are connected to the host computer 51. That is, when any of the printers 1 determine that a toner box 33 has reached it useful life, the printer properly registers the serial number of the used toner box 33 in the large memory capacity of the host computer 51. Therefore, poor image formation and damage due to use of an unsuitable toner box 33 can be prevented for all the printers 1. Further, because the serial numbers of used toner boxes 33 are stored in the memory of the host computer 51 during the registration process of S15, the serial number update subroutine shown in steps 16 and 17 of FIG. 7 can be dispensed with.

In the embodiment, in order for any of the printers 1 to compare the serial number read by the toner-box-serial-number reading process in S8 with the serial numbers of toner boxes 33 that were determined to have reached life end by other printers 1 connected to the network, all of the printers 1 transmit the serial numbers of used toner boxes 33 to the other printers 1 during the serial number update subroutine. Then, each printer 1 that responds to the same manufacturer search command uses the used-serial-number reading process to read the transmitted serial numbers and register the serial numbers in the serial number storage area in the NVRAM 37.

However, instead the toner box serial number read by the toner-box-serial-number reading process in S8 can be compared directly with the used serial numbers registered in the serial number storage area of the NVRAM 37 of the other printers 1.

Described in more detail, while the network interface 42*a* is active, the serial number read by the toner-box-serial-number reading process in S8 of the flowchart in FIG. 7 is compared in S10 with each used serial number registered in the serial number storage area of the NVRAM 37 of other printers 1 to determine whether the read serial number matches any serial numbers of used toner boxes 33. If the read serial number matches the serial number of a used toner box 33 then the presently mounted toner box 33 is determined to be unsuitable. With this configuration, the judgment processing S16 and the serial number update subroutine in S17 of the flowchart in FIG. 7, and also the process of registering serial numbers in the host computer 51 in S18 and S19 of the flowchart in FIG. 7 can be dispensed with.

Also, the printers 1 and the host computer 51 can be connected to an Internet server so that the printers 1 can determine suitability of toner boxes 33 using information from other printers connected to the Internet.

The embodiment describes that the life determination process in S11 of the flowchart in FIG. 7 determines that life of a toner box 33 is reached when the empty sensor 41 detects that the toner box 33 is empty. However, the life of the toner box 33 can be determined depending on, for example, the cumulative number of pages printed counted by a page counter. In this case, the number of pages that can be printed by the quantity of toner in the toner box 33 is predetermined. Then the page counter starts counting the number of pages printed from when a new toner box 33 is mounted in the printer 1, and stores the cumulative number in the cumulative number of pages printed storage area. When the cumulative number of pages printed reaches the pre-determined number mentioned above, the life of the toner box 33 is determined to have ended.

In this case, when a toner box 33 whose life was determined to have expired is replaced with a new toner box 33, the cumulative number of printed pages stored in the serial number storage area is initialized by the initialization process. It should be noted that a "new" toner box 33 is a toner box 33 whose serial number read by the toner-box-serial-number reading process is determined by the suitability determination process to be different from all of the used serial numbers.

By counting the cumulative number of pages printed using any particular toner box 33 and determining that the life of the toner box 33 is expired when the counted number of pages reaches a predetermined number, it is possible to precisely determine when the life of the toner box 33 expires. Also, once the life of toner box 33 has been determined to be reached, a new toner box 33 can be inserted into the printer 1. The new toner box 33 will be determined to be a suitable toner box 33 if the serial number of the new toner box 33 is different from any of the used serial numbers stored in the serial number storage area. In this case, the cumulative number of sheets printed stored in the cumulative number of sheets printed storage area on the NVRAM 37 is initialized by the initialization process. In this way, cumulative number of sheets printed by suitable toner boxes 33 can be repeatedly stored.

When the life of a toner box 33 is judged based upon the cumulative number of printed sheets in this manner, the cumulative number of printed sheets is counted and stored separately in correspondence with the serial number of the corresponding toner box 33. Therefore, even if a toner box 33 is temporarily removed, another toner box 33 is used in its place, and then the first toner box 33 is re-inserted again, the lives of the first toner box 33 and the temporary replacement toner box 33 can be precisely determined.

Also, the embodiment describes replacing only the toner box 33. However, the entire developing cartridge can be replaced. Further, the present invention can be applied to other consumable items, such as the fixing unit 11. In this case, the life of the fixing unit 11 could be based upon the cumulative number of sheets printed as described above and then the processes represented by the flowcharts of FIGS. 7 and 8 followed.

Figure 10:
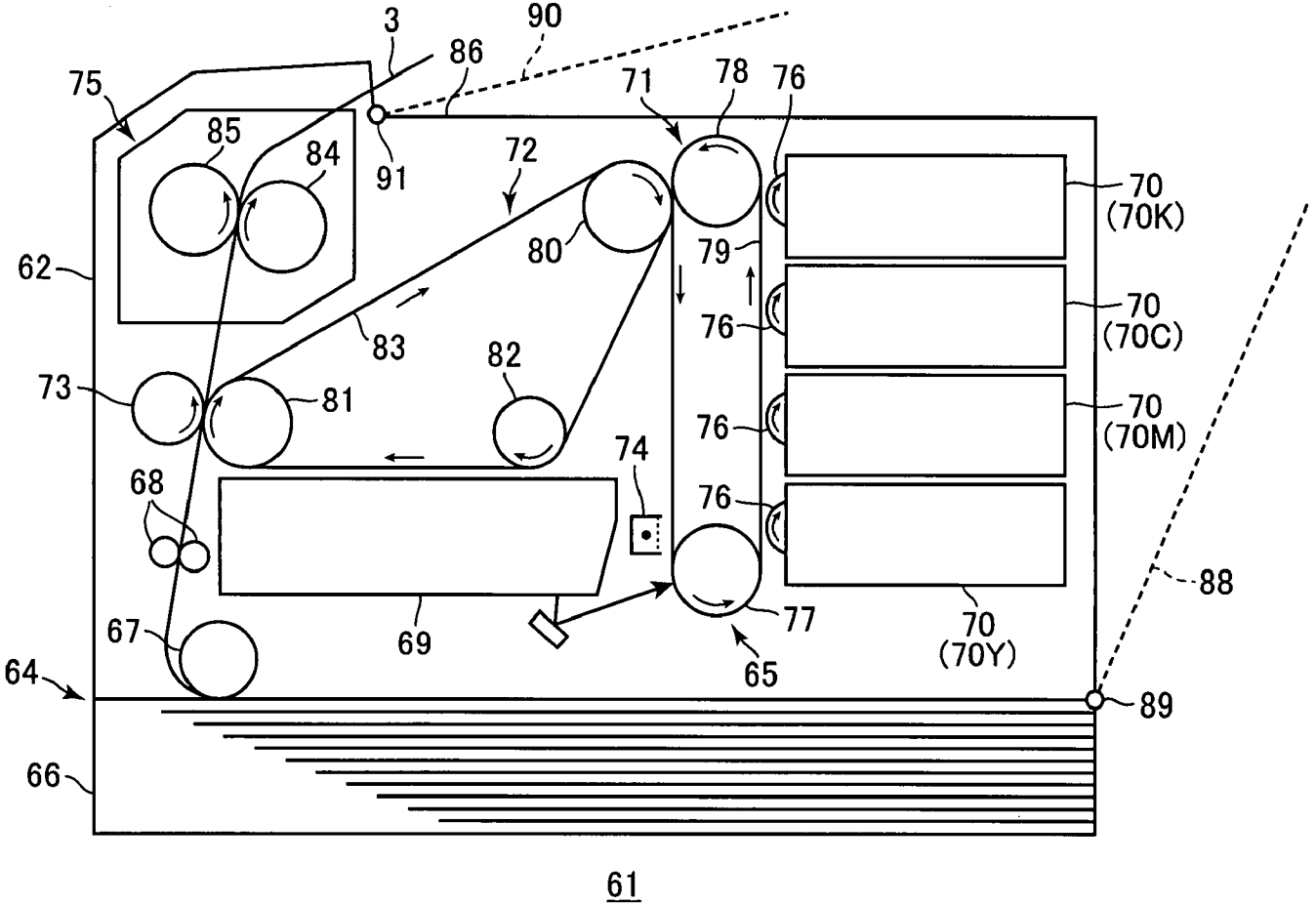
FIG. 10 is a sectional view showing main elements of a color laser printer according to a modification of the embodiment.

Also, the embodiment describes the present invention applied to a mono-chrome laser printer. However, the present invention can also be applied to a color laser printer. In this case, the suitability of the developing cartridge for each different color, a photosensitive belt mechanism, an intermediate transfer mechanism, and other consumable items can be determined. FIG. 10 shows a color laser printer 61 according to a modification of the embodiment.

As shown in FIG. 10, the color laser printer 61 includes a main casing 62, a sheet supply unit 64 for supplying sheets 3, and an image forming unit 65 for forming images on the supplied sheet 3.

The sheet supply unit 64 includes a sheet supply tray 66 and a rotatable sheet supply roller 67. Sheets 3 are stacked in the sheet supply tray 66 in the sheet supply unit 64. Also, a pair of register rollers 68 is disposed above the sheet supply roller 67. Sheets 3 supplied one sheet at a time by the sheet supply roller 67 are first subjected to a predetermined registration operation by the pair of register rollers 68. Then, each sheet 3 is transported to the image forming position, that is, to the position where a transfer roller 73 and a first intermediate transfer body support roller 81 contact each other.

The image forming unit 65 includes a scanner unit 69, four developing cartridges 70 that can be freely inserted into and removed from the color laser printer 61, a photosensitive belt mechanism 71, an intermediate transfer belt mechanism 72, a transfer roller 73, a scorotron charge unit 74, and a fixing unit 75.

The scanner unit 69 is disposed above the sheet supply unit 64 and below the intermediate transfer belt mechanism 72 within the main casing 62. Although not shown in the drawings, the scanner unit includes a laser light emitting unit, a rotatable polygon mirror, a plurality of lenses, and reflection mirrors. The laser emitting unit of the scanner unit 69 emits a laser beam based upon image data to irradiate the surface of a photosensitive belt 79, which is part of the photosensitive belt mechanism 71, through the polygon mirror, the lens, and the reflection mirrors in a high speed scan operation.

The four developing cartridges 70 include a yellow developing cartridge 70Y containing yellow toner, a magenta developing cartridge 70M containing magenta toner, a cyan developing cartridge 70C containing cyan toner, and a black developing cartridge 70K containing black toner. The four developing cartridges 70 are disposed at the rear of the main casing 62 and are aligned vertically from bottom to top parallel to each other and separated from each other by a predetermined distance.

Each developing cartridge 70 can be freely inserted into and removed from the main casing 62. Each developing cartridge includes a developing roller 76 and, although not shown in the drawings, a layer thickness regulating blade, a supply roller, and a toner housing chamber for holding the toner. Also, each developing cartridge 70 can be moved horizontally by an actuating mechanism not shown in the drawings, so that each developing roller 76 can come into contact with or be separated from the surface of the photosensitive belt 79.

The toner housing chamber of each of the developing cartridges 70 holds a single-component positively-charging, non-magnetic toner as the developing agent in the corresponding color (yellow, magenta, cyan, or black) of the developing cartridge.

The supply roller and developing roller 76 of each developing cartridge 70 are rotatably supported in pressing contact under a certain amount of pressure. The developing roller 76 rotates clockwise to move upward at the nip, that is, the position where the developing roller 76 is in contact with the photosensitive belt 79. Also, the developing roller 76 is applied with a developing bias with respect to the photosensitive belt 79. Also, the layer thickness regulating blade is disposed below the developing roller 76 and presses against the opposite surface of the developing roller 76 than where the developing roller 76 is in confrontation with the photosensitive belt 79.

An agitator not shown in the drawings agitates and feeds toner from the toner housing chamber to the supply roller and rotation of the supply roller supplies the toner to the developing roller 76. The toner is positively charged by friction while passing between the supply roller and the developing roller 76. Rotation of the developing roller 76 moves the toner supplied to the developing roller 76 between the developing roller 76 and the layer thickness regulating blade, whereupon the layer thickness regulating blade reduces the layer of toner on the developing blade 76 to a uniform thickness.

The photosensitive belt mechanism 71 is disposed in front of the four developing cartridges 70 and is capable of being freely inserted into or removed from the main casing 62. The photosensitive belt mechanism 71 includes a photosensitive body support roller 77, a photosensitive body drive roller 78, and the photosensitive belt 79. The photosensitive body support roller 77 is in confrontation with the yellow developing cartridge 70Y, which is the developing cartridge 70 in the lowermost position. The photosensitive body drive roller 78 is disposed vertically above the photosensitive body support roller 77 and in confrontation with the black developing cartridge 70K, which is the developing cartridge 70 in the uppermost position. The photosensitive belt 79 is an endless belt wound around the photosensitive body support roller 77 and the photosensitive body drive roller 78. Also, the photosensitive belt 79 includes a photosensitive layer on the surface of the photosensitive belt 79. The photosensitive layer is made from an organic photosensitive material. The photosensitive belt 79 is disposed vertically and in confrontation with each of the developing rollers 76.

The photosensitive belt mechanism 71 transmits motive force from a drive motor not shown in the drawings to the photosensitive body drive roller 78. When the photosensitive body drive roller 78 is driven in the counter-clockwise direction of FIG. 10, the photosensitive body support roller 77 rotates in the counter-clockwise direction of FIG. 10 in response. As a result, the photosensitive belt 79 rotates in the counter-clockwise direction of FIG. 10 around the photosensitive body support roller 77 and the photosensitive body drive roller 78. In this way, the photosensitive belt 79 moves from the position of the developing roller 76 of the lowest yellow developing cartridge 70Y towards the position of the developing roller 76 of the highest black developing cartridge 70K. In other words, the photosensitive belt 79 moves in the same upward direction as the developing rollers 76 at the nip positions, that is, where the photosensitive belt 79 contacts each developing roller 76.

The intermediate transfer belt mechanism 72 is disposed above the scanner unit 69 and in front of the photosensitive belt mechanism 71 and can be freely inserted into or removed from the main casing 62. The intermediate transfer belt mechanism 72 includes three rollers, namely an intermediate transfer body drive roller 80, the first intermediate transfer body support roller 81, a second intermediate transfer body roller 82, and an intermediate transfer belt 83. The intermediate transfer belt 83 is an endless belt made from an electrically-conducting resin in which carbon or some other electrically-conducting particles are dispersed. Examples of electrically-conducting resin include polycarbonate, polyamide, polyimide, polyamideimide, and polyvinylidene fluoride.

The intermediate transfer body drive roller 80 is disposed in confrontation with the photosensitive body drive roller 78 through the photosensitive belt 79 and the intermediate transfer belt 83. The first intermediate transfer body roller support 81 is disposed to the front of and below the intermediate transfer body drive roller 80 and is in confrontation with the transfer roller 73 through the intermediate transfer belt 83. The second intermediate transfer body support roller 82 is disposed below the intermediate transfer body drive roller 80 and to the rear of the first intermediate transfer body support roller 81. The intermediate transfer body drive roller 80, the first intermediate transfer body support roller 81, and the second intermediate transfer body support roller 82 are arranged in a triangular configuration. The intermediate transfer belt 83 is wound around the intermediate transfer rollers 80 through 82.

The intermediate transfer belt mechanism 72 transmits motive force from a drive motor not shown in the drawings to the intermediate transfer body drive roller 80. The intermediate transfer body drive roller 80 is driven in the clockwise direction of FIG. 10 and the first intermediate transfer body support roller 81 and the second intermediate transfer body support roller 82 rotate in the clockwise direction of FIG. 10 in response. This rotates the intermediate transfer belt 83 in the clockwise direction of FIG. 10 around the intermediate transfer rollers 80 to 82. In this way, the intermediate transfer belt 83 moves in the same direction as the photosensitive belt 79 at the nip point where the intermediate transfer belt 83 comes into confrontation with and into contact with the photosensitive belt 79 at the intermediate transfer body drive roller 80.

The transfer roller 73 is in contact with the surface of the intermediate transfer belt 83 and is in confrontation with the first intermediate transfer body support roller 81 of the intermediate transfer belt mechanism 72 through the intermediate transfer belt 83. The transfer roller 73 moves in the same direction, that is, the counter-clockwise direction of FIG. 10, as the intermediate transfer belt 83 at the nip point between the transfer roller 73 and the first intermediate transfer body support roller 81. Also, a transfer bias is applied to the transfer roller 73 with respect to the intermediate transfer belt 83.

The scorotron charge unit 74 is disposed at a predetermined distance from and out of contact from the surface of the photosensitive belt 79. The scorotron charge unit 74 is disposed near to and upstream from the photosensitive body support roller 77 relative to the direction of movement of the photosensitive belt 79. The scorotron charge unit 74 is a positively-charging scorotron charge unit similar to the scorotron charge unit 14 and charges the photosensitive belt 79 to a uniform positive charge.

After the surface of the photosensitive belt 79 is uniformly positively charged by the scorotron charge unit 74, the scanner unit 69 emits a laser beam to expose the surface of the photosensitive belt 79 in a high speed scan. This forms an electrostatic latent image on the surface of the photosensitive belt 79 based upon image data.

Next, an actuating mechanism not shown in the drawings moves one of the developing cartridges 70 so that the developing roller 76 contacts the photosensitive belt 79 on which the electrostatic latent image has been formed. As a result, a visible image in the single color of the specific developing cartridge 70 is formed on the photosensitive belt 79. Next, the single-color visible image formed on the photosensitive belt 79 is transferred to the intermediate transfer belt 83 when it comes into confrontation with the intermediate transfer belt 83. A multi-color image is formed on the intermediate transfer belt 83 by successively superimposing single-color images onto the intermediate transfer belt 83.

In other words, first the actuating mechanism not shown moves the yellow developing cartridge 70Y at the lowest position horizontally forward to bring the developing roller 76 of the yellow developing cartridge 70Y into contact with the photosensitive belt 79 on which the electrostatic latent image has been formed. At the same time the magenta developing cartridge 70M, the cyan developing cartridge 70C and the black developing cartridge 70K are moved horizontally to the rear, so that the remaining developing rollers 76 are separated from the photosensitive belt 79. As a result, a yellow visible image is formed on the photosensitive belt 79 with the yellow toner contained in the yellow developing cartridge 70Y. Next, the yellow visible image is transferred to the intermediate transfer belt 83 when the yellow visible image comes into confrontation with the intermediate transfer belt 83 through the movement of the photosensitive belt 79.

Next, an electrostatic latent image is again formed on the photosensitive belt 79. Then the actuating mechanism not shown moves the developing roller 76 of the magenta developing cartridge 70M, which is second from the bottom, into contact with the photosensitive belt 79. At this time, the remaining developing rollers 76 are separated from the photosensitive belt 79. As a result, a magenta visible image is formed on the photosensitive belt 79 by magenta toner contained in the magenta developing cartridge 70M. Next, the magenta visible image is superimposed on the intermediate transfer belt 83 on which the yellow image has already been transferred, when the magenta visible image comes into confrontation with the intermediate transfer belt 83.

Similar operations are repeated for the cyan toner contained in the cyan developing cartridge 70C and the black toner contained in the black developing cartridge 70K, and in this way a multi-colored image is formed on the intermediate transfer belt 83.

Then, the multi-colored image formed in this way on the intermediate transfer belt 83 is transferred in one operation onto the sheet 3 when the sheet 3 passes between the intermediate transfer belt 83 and the transfer roller 73.

The fixing unit 75 is disposed above the transfer roller 73 and on the opposite end of the photosensitive belt mechanism 71 than the developing cartridges 70. The fixing unit 75 includes a heating roller 84 and a pressure roller 85 that presses against the heating roller 84. The heating roller 84 is made from metal and includes a halogen lamp for heating. When the sheet 3 passes between the heating roller 84 and the pressure roller 85 the multi-colored image transferred onto the sheet 3 is fixed in place onto the sheet 3. Then the sheet 3 that has had the multi-colored image thermally fixed in the fixing unit 75 is discharged into the sheet discharge tray 86 formed in the top of the main casing 62.

Also, a front cover 88 is provided in the front of the main casing 62 as indicated by a dotted line in FIG. 10. This front cover 88 is supported by a hinge 89 to the bottom of the front of the main casing 62 so that it can open and close. In order to replace the developing cartridges 70, the front cover 88 is opened so that the cartridges 70 can be removed from and inserted into the main casing 61.

Also, a top cover 90 is provided in the top of the main casing 62 as indicated by a dotted line in FIG. 10. The top cover 90 is supported by a hinge 91 in the top of the main casing 62 so that it can open and close. In order to remove the photosensitive belt mechanism 71 or the intermediate transfer belt mechanism 72, the top cover is opened so that the photosensitive belt mechanism 71 and the intermediate transfer belt mechanism 72 can be removed from and inserted into the main casing 61.

Various consumable items of the color laser printer 61, such as the developing cartridges 70, the photosensitive belt mechanism 71, and the intermediate transfer belt mechanism 72, are provided with an individual serial number. The life of these components can be determined, for example, by the cumulative number of sheets printed in the manner described above. When a component is replaced, the suitability of the replacement component can be determined by implementing the processes represented in the flowcharts in FIG. 7 and FIG. 8. Use of unsuitable developing cartridges 70, photosensitive belt mechanisms 71, intermediate transfer belt mechanism 72, and other consumable items can be prevented.

Although the embodiment and the above modifications describe the present invention applied to a laser printer, the present invention could be applied to any type of image forming apparatus, such as an ink-jet printer. In this case, the consumable items would be ink cartridges, ink jet heads, and so on.

Also, the embodiment describes that the toner boxes 33 are provided with distinction information in the form of an IC chip 45 that is made from a semi-conducting element and that is provided with a serial number. However, the distinction information for consumable items is not limited to this configuration. For example, the distinction information can be provided as a bar code printed or otherwise provided on a label fixed to the component. In this case, when the consumable item is determined to be unsuitable, then the distinction information indicated by the bar code can be eliminated by painting over the bar code or peeling off the bar code, for example.

Also, the embodiment describes storing a serial number in the IC chip 45. However, other information, such as the quantity of toner consumed or the number of sheets printed in total (i.e., the accumulated number of sheets) using the present toner box, can be stored in the IC chip 45 in addition to or instead of a serial number.

As described above, the present invention is for preventing damage to an image forming apparatus in the event that an unsuitable consumable item is used in the apparatus. Normally it is very difficult for a user without technical knowledge to determine whether a consumable item that is about to be provided in the image forming apparatus is suitable for the image forming apparatus or not. On the other hand, a manufacturer with technical knowledge can recycle a consumable item whose life has expired, so that the consumable item is again suitable for use in the printer even though the life of the consumable item was once considered to have expired. For example, the manufacturer can re-fill the toner box 33 with toner that was suitable for the laser printer 1 so that the toner box 33 can be recycled, or can replace the photosensitive belt 79 of a photosensitive belt mechanism 71 so that photosensitive belt mechanism 71 can be recycled. However, according to the embodiment, such a consumable item would be judged to be unsuitable for use in the printer because it would have the same distinction information (serial number) as when judged to have reached life end.

The embodiment can be modified so that when a consumable item is properly re-cycled for reuse, the distinction information is also changed to new distinction information. For example, when the consumable item is provided with the IC chip 45 and the IC chip 45 is destroyed so that the serial number can no longer be read as in the embodiment, then the old IC chip 45 could be removed and a new IC chip 45 with a new serial number could be installed on the consumable item. On the other hand, the embodiment could be further modified so that the IC chip 45 is not destroyed, but rather the serial number or other distinction information in the IC chip 45 is eliminated by being electronically re-written. If the distinction information is provided in the form of a bar code printed or otherwise provided on a label attached to the consumable item, a new label with a new bar code can be attached over the original label to eliminate the old distinction information.

By this method, new distinction information is provided to a re-cycled consumable item, and it is possible to avoid the consumable item being determined to be unsuitable when it is re-used. Because of this it is possible to re-use re-cycled consumable items whose life had been determined to have expired, allowing resources to be efficiently utilized and waste to be minimized.

The quantity of distinction information increases as the number of consumable items increases. For example, when serial numbers are used to identify individual consumable items, the number of digits in the serial number will increase as the number of consumable items increases. As a result, the storage unit (memory) needs to have a large storage capacity when there is a large number of consumable items. Related serial numbers can be grouped together, for example in sets of 65536 serial numbers, in order to reduce the need for a large storage capacity. That is, an individual entry is stored for each serial number until a group of 65536 used serial numbers is reached. Then, all the lower digits (i.e., up to 65536) are erased and only the upper digits for that group stored and referred to.

What is claimed is:

1. An image forming apparatus that uses a plurality of consumable items one at a time, each of the consumable items being provided to the image forming apparatus during use and having a usable life that ends when the consumable item reaches life end, each of the consumable items being provided with a distinction information indicator that indicates information for distinguishing between individuals in the plurality of consumable items, the image forming apparatus comprising:

a distinction information reading unit that reads the distinction information indicated by the distinction information indicator of each consumable item that is presently provided;

a life end determining unit that judges whether a consumable item that is presently being used has reached life end;

a memory;

a registering unit that registers, in the memory and for each consumable item that the life end determining unit judges to have reached life end, the distinction information read by the distinction information reading unit; and a suitability determining unit that determines that a consumable item that is presently provided is unsuitable for use when distinction information read by the distinction information reading unit for the consumable item that is presently provided is the same as distinction information registered in the memory.

2. The image forming apparatus as claimed in claim 1, further comprising:

a communication unit for communicating with other image forming apparatuses; and a registered information determination unit that, by using the communication unit, determines the distinction information of consumable items that other image forming apparatuses determined to have reached life end, the suitability determining unit determining that a consumable item that is presently provided is unsuitable for use when distinction information read by the distinction information reading unit for the consumable item that is presently provided is the same as distinction information determined by the registered information determination unit.

3. The image forming apparatus as claimed in claim 1, further comprising:

a detection unit that detects cumulative use of a consumable item presently provided;

a storage unit for storing the cumulative use detected by the detection unit; and an initialization unit that initializes the cumulative use stored by the storage unit.

4. The image forming apparatus as claimed in claim 3, further comprising a consumable item replacement detector that detects when a consumable item that is presently provided is replaced with another consumable item, the initialization unit initializing the cumulative use stored by the storage unit when the consumable item replacement detector detects that a consumable item is replaced.

5. The image forming apparatus as claimed in claim 1, wherein the suitability determining unit determines that the consumable item that is presently provided is unsuitable for use when the distinction information reading unit is unable to read the distinction information of the consumable item that is presently provided.

6. The image forming apparatus as claimed in claim 1, further comprising an elimination unit that eliminates the distinction information from the distinction information indicator of the consumable item that is presently provided when the suitability determining unit determines that the consumable item is unsuitable for use.

7. The image forming apparatus as claimed in claim 6, wherein the distinction information indicators are semi-conducting elements, the elimination unit applying an excessive voltage to the semi-conducting element of the consumable item that is presently provided to eliminate the distinction information.

8. The image forming apparatus as claimed in claim 1, further comprising:

an image forming unit that forms images on a recording medium; and an image formation preventor that prevents image formation by the image forming unit when the suitability determining unit determines that the consumable item that is presently provided is unsuitable for use.

9. The image forming apparatus as claimed in claim 8, wherein the image forming unit requires image data to form images, the image formation preventor preventing image formation by prohibiting receipt of image data from an external source.

10. The image forming apparatus as claimed in claim 1, further comprising a display that displays a message indicating that the consumable item being is unsuitable for use when the suitability determining unit determines that the consumable item that is presently provided is unsuitable for use.

11. The image forming apparatus as claimed in claim 1, further comprising an image formation unit that performs image formation operations using developing agent, the consumable items being developing agent containing units for holding the developing agent used by the image formation unit.

12. An image forming apparatus that uses a plurality of consumable items one at a time, each of the consumable items being provided to the image forming apparatus during use and being provided with a semi-conductor element that stores information, the image forming apparatus comprising:

an image formation unit that performs image formation operations for forming images on a recording medium; and an eliminating unit that selectively eliminates information from a semi-conductor element of a consumable item that is presently provided by applying an excessive voltage to the semi-conductor element of the consumable item that is presently provided.

13. The image forming apparatus as claimed in claim 12, wherein the image formation unit performs image formation operations using developing agent, the consumable items being developing agent containing units for holding the developing agent used by the image formation unit.

14. A method of changing consumable items in an image forming apparatus, the method comprising:

providing a distinction information indicator to each consumable item, each distinction information indicator indicating distinction information for distinguishing each of the plurality of consumable items from others of the plurality of consumable items;

judging life end of a consumable item that is presently being used in the image forming apparatus;

reading distinction information indicated by a distinction information indicator of each consumable item judged to have reached life end;

registering, in a memory, distinction information indicated by a distinction information indicator of each consumable item judged to have reached life end;

judging whether distinction information indicated by a distinction information indicator of a consumable item that is presently provided in the image forming apparatus is the same as distinction information registered in the memory;

determining that the consumable item that is presently provided is unsuitable for use in the image forming apparatus when the distinction information indicated by the distinction information indicator of the consumable item that is presently provided is judged to be the same as distinction information registered in the memory.

15. The method as claimed in claim 14, wherein the step of registering distinction information registers the distinction information in a memory provided in the image forming apparatus.

16. The method as claimed in claim 14, wherein the step of judging whether distinction information is the same includes comparing distinction information indicated by the distinction information indicator of the consumable item that is presently provided with distinction information registered in a memory of another image forming apparatus that is connected to the image forming apparatus.

17. The method as claimed in claim 14, wherein:

the step of registering in the memory includes registering in a memory of a host computer that is connected to the image forming apparatus; and the step of judging whether distinction information is the same includes comparing distinction information indicated by the distinction information indicator of the consumable item that is presently provided with the distinction information registered in the memory of the host computer.

18. The method as claimed in claim 14, further comprising:

detecting cumulative use of a consumable item that is presently provided;

storing the cumulative use in a cumulative use memory, the step of judging life end including judging that the consumable item that is presently being used has reached life end when the cumulative use stored in the cumulative use memory is equal to or greater than a predetermined amount;

comparing, with registered distinction information, distinction information indicated by a distinction information indicator of a subsequently consumable item provided after a consumable item is judge to have reached life end; and initializing the cumulative use memory when no registered distinction information is the same as the distinction information indicated by the distinction information indicator of the subsequent consumable item.

19. The method as claimed in claim 14, further comprising reading distinction information indicated by a distinction information indicator of a consumable item that is presently provided, the consumable item that is presently provided being judged to be unsuitable for use when the distinction information cannot be read.

20. The method as claimed in claim 14, further comprising eliminating distinction information indicated by the distinction information indicator of the consumable item that is presently provided when the life end of the consumable item that is presently being used is judged to have been reached.

21. The method as claimed in claim 14, further comprising preventing image forming processes when the consumable item that is presently provided is judged to be unsuitable for use.

22. The method as claimed in claim 14, further comprising:

replacing the distinction information indicator of the consumable item that is judged to have reached life end with a new distinction information indicator that indicates new distinction information; and reusing the consumable item in the image forming device.

23. A system of image forming apparatuses connected to each other through a network, each image forming apparatus using a plurality of consumable items one at a time, each of the consumable items being provided to the image forming apparatus during use and having a usable life that ends when the consumable item reaches life end, each of the consumable items being provided with a distinction information indicator that indicates information for distinguishing between individuals of the plurality of consumable items, the system comprising:

a memory; and a plurality of image forming apparatuses, each image forming apparatus including:

a distinction information reading unit that reads the distinction information indicated by the distinction information indicator of a consumable item that is presently provided;

a life end determining unit that judges whether a consumable item that is presently being used has reached life end;

a registering unit that registers, in the memory and for each consumable item that the life end determining unit judges to have reached life end, the distinction information read by the distinction information reading unit; and a suitability determining unit that determines that a consumable item that is presently provided is unsuitable for use when distinction information read by the distinction information reading unit for the consumable item that is presently provided is the same as distinction information registered in the memory.

24. The system as claimed in claim 23, wherein the memory includes a plurality of memories each provided to a corresponding one of the plurality of image forming apparatuses.

25. The system as claimed in claim 23, further comprising a host computer connected to the plurality of image forming apparatuses, the memory being provided in the host computer, the registering unit of each of the image forming apparatuses registering the distinction information in the host computer by transmitting the distinction information to the host computer.

26. The system as claimed in claim 23, wherein each of the plurality of image forming apparatuses includes:

an image forming unit that forms images on a recording medium; and an image formation preventor that prevents image formation by the image forming unit when the suitability determination unit determines that the consumable item that is presently provided is unsuitable for use.

27. A printer, comprising:

a communication unit for communicating with a host computer;

a memory; and a comparison unit;

wherein:

the communication unit is configured to retrieve distinction information associated with one or more used consumable items from the host computer and store the distinction information associated with one or more used consumable items in the memory;

the comparison unit is configured to compare distinction information associated with a consumable item installed in the printer with the stored distinction information associated with one or more used consumable items; and printing is prohibited when the comparison unit determines that the distinction information associated with the consumable item installed in the printer corresponds to any of the stored distinction information associated with one or more used consumable items.

28. The printer of claim 27, wherein the communication unit comprises at least one of a network interface and a parallel interface.

29. The printer of claim 27, wherein the communication unit is configured to communicate with the host computer over the internet.

30. The printer of claim 27, wherein the memory comprises at least one of RAM, NVRAM and ROM.

31. The printer of claim 27, wherein the consumable items are toner boxes.

32. The printer of claim 27, wherein:

the distinction information associated with one or more used consumable items comprises one or more serial numbers associated with the one or more used consumable items; and the distinction information associated with the consumable item installed in the printer comprises a serial number associated with the consumable item installed in the printer.

33. The printer of claim 32, wherein printing is prohibited when the comparison unit determines that the serial number associated with the consumable item installed in the printer is identical to any of the stored serial numbers associated with one or more used consumable items.

34. A host computer, comprising:

a communication unit for communicating with a printer; and a memory;

wherein the communication unit is configured to retrieve distinction information associated with a consumable item that is unsuitable for use from the printer and store the distinction information in the memory, the consumable item being unsuitable for use when the printer judged that the consumable item reached life end.

35. The host computer of claim 34, wherein the communication unit is configured to communicate with the printer over the internet.

36. The host computer of claim 34, wherein the consumable item is a toner box.

37. The host computer of claim 34, wherein the distinction information associated with the consumable item that is unsuitable for use comprises a serial number associated with the consumable item that is unsuitable for use.

38. The host computer of claim 34, wherein the communication unit is configured to retrieve distinction information associated with consumable items that are unsuitable for use from a plurality of printers.

39. The host computer of claim 34, wherein judgment that the consumable item is unsuitable for use is performed automatically upon mounting the consumable item in the printer.

* * * * *